US007984571B2

(12) United States Patent
Pellegrini

(10) Patent No.: US 7,984,571 B2
(45) Date of Patent: Jul. 26, 2011

(54) SPORT FOOTWEAR, IN PARTICULAR SKI BOOT, PROVIDING AN EASY ENTRANCE AND EXTRACTION OF THE FOOT

(75) Inventor: Alfred Pellegrini, Montebelluna (IT)

(73) Assignee: Tecnica SpA, Giavera Del Montello (Treviso) (IT)

( * ) Notice: Subject to any disclaimer, the term of this patent is extended or adjusted under 35 U.S.C. 154(b) by 790 days.

(21) Appl. No.: 11/911,769

(22) PCT Filed: Jun. 16, 2005

(86) PCT No.: PCT/IT2005/000341

§ 371 (c)(1),
(2), (4) Date: Jan. 10, 2008

(87) PCT Pub. No.: WO2006/134617

PCT Pub. Date: Dec. 21, 2006

(65) Prior Publication Data

US 2008/0148603 A1 Jun. 26, 2008

(51) Int. Cl.
*A43B 5/04* (2006.01)

(52) U.S. Cl. ..... 36/117.1; 36/50.5

(58) Field of Classification Search ..... 36/117.1, 36/50.5, 117.6

See application file for complete search history.

(56) References Cited

U.S. PATENT DOCUMENTS

| | | | | |
|---|---|---|---|---|
| 5,381,611 | A * | 1/1995 | Tonel et al. | 36/117.1 |
| 5,553,400 | A * | 9/1996 | Wittmann et al. | 36/50.5 |
| 5,553,401 | A * | 9/1996 | Wittmann et al. | 36/117.6 |
| 5,611,154 | A * | 3/1997 | Lucchetta et al. | 36/50.5 |
| 5,718,065 | A * | 2/1998 | Locker | 36/117.1 |
| 6,112,435 | A * | 9/2000 | Collavo | 36/117.1 |
| 6,779,284 | B2 * | 8/2004 | Cagliari et al. | 36/117.1 |
| 6,829,846 | B2 * | 12/2004 | Cagliari et al. | 36/50.5 |

FOREIGN PATENT DOCUMENTS

| | | |
|---|---|---|
| DE | 19815344 | 6/1999 |
| EP | 0551881 A | 7/1993 |
| WO | WO03/001937 A | 1/2003 |

OTHER PUBLICATIONS

International Search Report and Written Opinion dated Feb. 20, 2006 from the corresponding PCT/IT2005/000341.

* cited by examiner

*Primary Examiner* — Marie Patterson
(74) *Attorney, Agent, or Firm* — Katten Muchin Rosenman LLP

(57) ABSTRACT

Sport footwear, in particular ski boot, having passage openings (16, 19) for the wearer's. foot provided frontally in the lower shell (10) and the leg-piece (20). At least the opening (19) in the leg-piece (20) is capable of being closed by two flaps (22, 23), of which at least one is in the form of a pad (23) coupled to the remaining portion (25) of the leg-piece (20) with a clearance fit allowing said pad (23) to freely rotate in view of enabling the wearer's foot to be most smoothly and conveniently introduced in and subsequently extracted from the footwear.

6 Claims, 4 Drawing Sheets

SPORT FOOTWEAR, IN PARTICULAR SKI BOOT, PROVIDING AN EASY ENTRANCE AND EXTRACTION OF THE FOOT

TECHNICAL FIELD OF THE INVENTION

The present invention refers to a sport footwear comprising, further to a leg-piece articulated on a (lower) shell and an optional soft inner lining shoe, two side flaps that are adapted to cover the opening for introduction and extraction of the user's foot. The reference made throughout this description to ski boots shall not be understood as limiting the field of the invention.

BACKGROUND OF THE INVENTION

The purpose of the above-cited flaps, which extend at least along the instep and are adapted to be superimposed upon each other, is to take up and distribute the forces originating at the moment the boot is tightly closed and fastened onto the wearer's foot. In addition, they are of course intended to prevent snow from penetrating into the boot itself.

Owing to the fact that the wearer's foot may be introduced into a ski boot or extracted therefrom even under prevailing conditions of quite low temperatures, e.g. outside on the skiing ground, the details concerning the opening where said flaps are provided are of a major consideration when designing a new boot model.

Then, since the flaps are usually moulded integrally as a unitary piece with the shell and leg-piece of the boot, respectively, and must be capable of most easily open apart even under the conditions of quite low temperatures, the flaps are designed as very thin parts, i.e. parts with a reduced thickness which represent a weak point in the construction of a boot.

A first solution to such problem is known from DE-A-198 15 344; this solution envisages the use of strips of textile material as hinges for connecting the flaps to the rest of the lower and upper shell, respectively. Notwithstanding the use of textile materials of a high tensile strength and impermeability to water (e.g., plastics-impregnated textiles), it can be reasonably expected that—at least after a more or less extended period of use of the boot—the flaps will structurally undergo a certain extent of yielding that will prevent them from closing in a uniform manner the opening of the boot.

Another solution, known from U.S. Pat. No. 5,553,401, envisages to make the flaps as parts to be moulded separately from the leg-piece and the shell of the boot and, as a result, loose, i.e. disengaged from the means (levers and racks) used to fasten the boot. Each flap has a lower or concealed portion that is moulded integrally as a unitary piece with an upper or exposed portion (which distributes the pressure originated and imposed by the fastening means) to which is connected via a thin-film hinge. Said upper portion of the flap opens and closes with a transverse movement for permitting the foot to slip into and out of the boot, whereas the lower portion is secured by means of a bolt to shell of the boot and is able to slide in the longitudinal direction of the boot. Quite clearly, due to the repeated flexural stresses they are going to be subject to, thin-film hinges represent weak points of the boot.

A third solution, known from WO-A-03 001937, envisages the use of panels in the form of real lids connected to the shell and/or the leg-piece of a ski by metal book-like (flat) hinges. Anyway, even this kind of hinges represents a critical aspect in the boot design, especially when the hinges need to be replaced; they furthermore are relatively expensive parts.

At last, from EP-A-551 881 a footwear for ski is known which comprises one or more interchangeable flaps removably associable with the quarter (leg-piece) and/or with the shell through rivets integrally formed with the flaps.

OBJECT OF THE INVENTION

It therefore is a main aim of the present invention to provide a ski boot, in which introducing the foot into the boot and, extracting therefrom, is quite easy to perform.

Another aim is to provide a reliable and effective solution to the problem of enabling the wearer's foot to most easily slip into and off the boot under any environmental condition in which it may be used, and turns furthermore out as being a relatively inexpensive solution.

According to the present invention, these and further aims are reached by a ski boot structure incorporating the features as defined and recited in the appended claims. In particular, the present invention envisages the use of at least a pad, in which the border of such pad on the opposite side of the border where the boot fastening means are intended to act is housed with a certain clearance in a seat provided in the remaining portion of the leg-piece. The pad is moulded as a separate part and preferably more rigid.

SHORT DESCRIPTION OF THE DRAWINGS

The main features and advantages of the present invention will be more readily understood from the description of a preferred embodiment that is given below by way of non-limiting example with reference to the accompanying drawings, in which.

DESCRIPTION OF A PREFERRED EMBODIMENT

Figure 1:
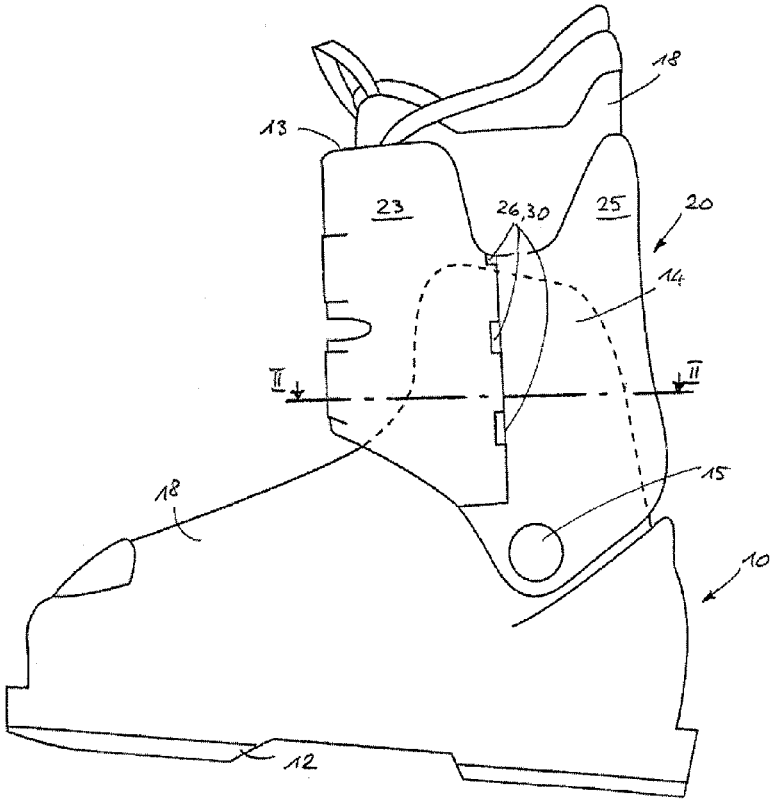
FIG. 1 is a view of the internal side of a ski boot, which is illustrated without the traditional buckle-and-rack fastening means for a better clarity, wherein the pad of the leg-piece according to the present invention is shown in the closed state.

As shown in the figures, the ski boot comprises a lower shell and a leg-piece, generally indicated at 10 and 20, respectively, which are in a well known manner manufactured out of injection-moulded synthetic materials, as well a soft inner lining shoe 18 (partially visible) where the user foot is comfortably received and accommodate the foot of the skier. Starting from a rigid sole 12, the shell 10 comprises a portion 14, which—as illustrated by a dashed line in FIG. 1—extends beyond and above the horizontal-axis articulation pins 15 connecting the shell 10 with the leg-piece 20 so that the latter is able to deflect (within pre-established limits) forward and backward.

Figure 2:
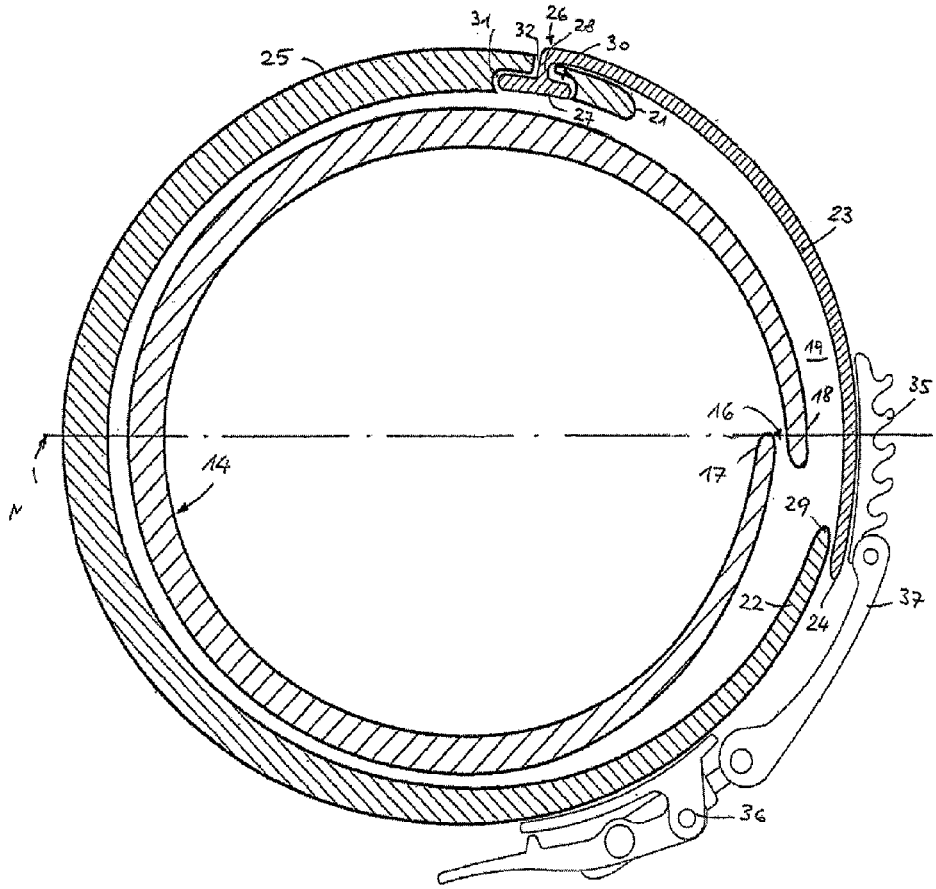
FIG. 2 is a simplified cross-sectional view of the boot along the plane II-II in FIG. 1, wherein the leg-piece is shown in the closed state.
Figure 3:
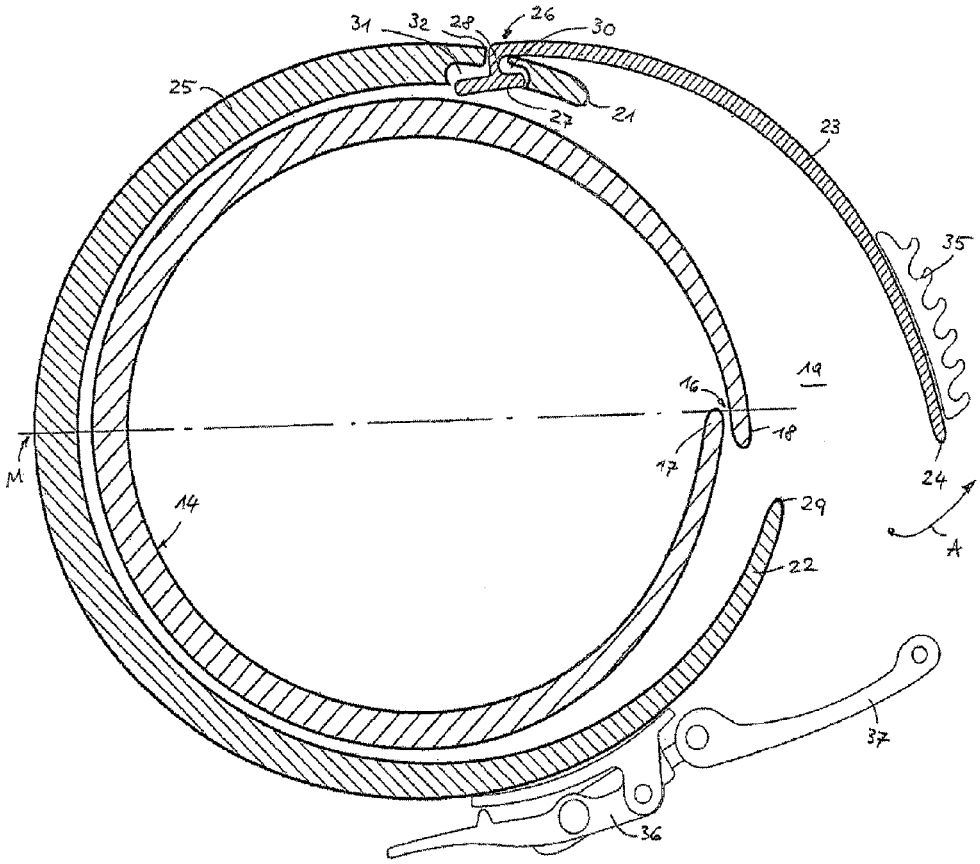
FIG. 3 is a similar to FIG. 2, but the leg-piece is shown in the state in which the pad starts to be opened.
Figure 4:
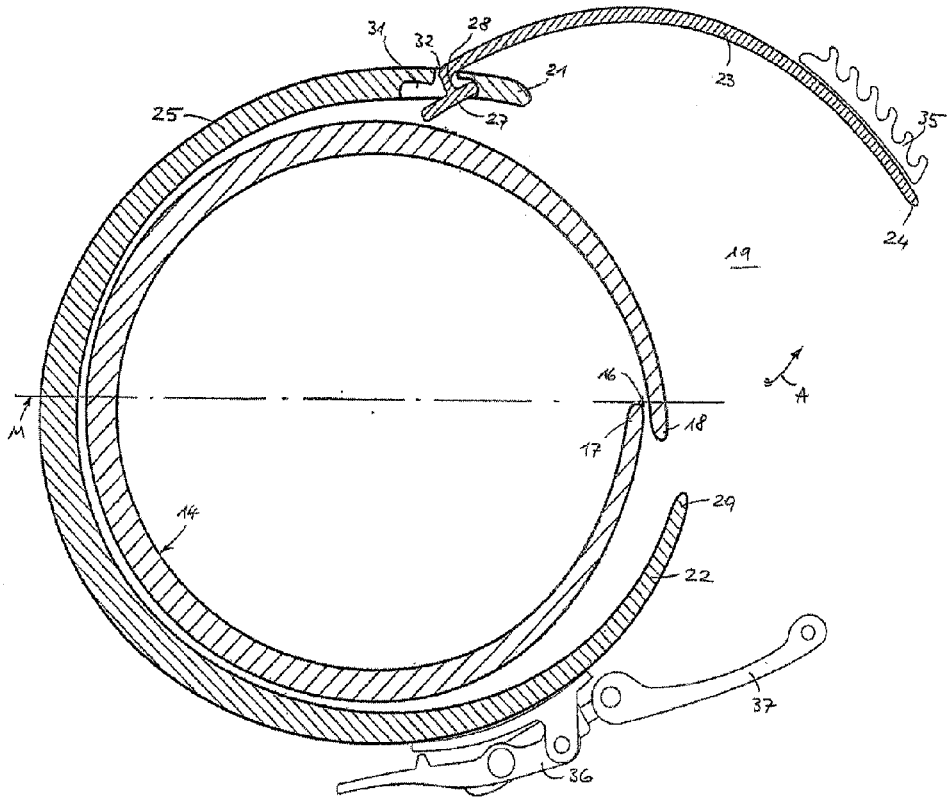
FIG. 4 is similar to FIGS. 2 and 3, but the leg-piece is shown in the state in which the pad has been fully opened.

In order to allow for the foot introduction into the boot, and its subsequent extraction therefrom, the shell 10 is provided with a front passage opening 16 extending approximately along the longitudinal mid plane M of the boot and adapted to be closed when two parallel, relatively flexible flaps 17 and 18 (which, as can be seen in FIGS. 2, 3 and 4 are integrally made with the shell 10) are partially superimposed upon each other. Even the leg-piece 20 has, approximately along mid plane M, a passage opening 19 that reaches up to the free upper edge 13 of the leg-piece 20 and is closable by two flaps 22 when they are partially superimposed upon each other, as explained in greater detail below.

According to a major feature of the present invention, the leg-piece 20 is comprised of at least two portions, which are moulded separately and subsequently joined to each other in an articulated manner.

The first portion of the leg-piece 20, which forms also the flap of the passage 19 situated on the internal side of the boot (i.e. the side that faces the other boot during use), consists of a pad 23 on which there is secured, close to the free edge 24 thereof extending approximately vertically, at least a rack 35. This pad 23 is a part of the boot that is moulded separately from the rest of the leg-piece 20, so that it can most advantageously be made of a higher-grade synthetic material having superior mechanical properties.

The second portion 25 of the leg-piece 20 comprises the other flap 22 of the passage opening 19, i.e. the flap situated on the external side of the boot. Thanks to the greater robustness ensured by the pad 23, the flap 22 can also be thinner than in conventional boots construction; it terminates with a free edge 29 that, during use, i.e. when the wearer's foot is inside the boot, remains under the free edge 24 of the pad 23 so as to close the passage opening 19. To this flap 22 there is secured the lever 36 connected to the buckle 37 that, jointly with the rack 35, is part of generally well-known fastening means of the boot.

The three cross-sectional views appearing in FIGS. 2, 3 and 4 show how, according to a feature of the present invention, the first portion or pad 23 is joined to the second portion 25 of the leg-piece 20 through a clearance fit. To this purpose, the second edge 26 of the pad 23 has a cross-section in the shape of a T, wherein the transverse member 27 of said T (i.e. the distal portion of the edge 26) is bent at substantially right angle relative to both the base member 28 of the T (i.e. the proximal portion of the edge 26) and the pad 23 itself, under which it extends partially. In the finished boot, the whole second edge 26 of the pad 23, i.e. both the distal and the proximal portions 27 and 28, is housed in a seat 30 provided close to the second edge 21 of the second portion 25 of the leg-piece 20—see FIG. 2.

To this purpose, also the seat 30 has a cross-section in the shape of a T, wherein the transverse portion 31 of said T-shaped seat 30 has a width and a thickness that are larger than the width and the thickness of the transverse member 27 of the second edge 26 of the pad 23, whereas the base portion 32 of said T-shaped seat 30 has a greater width and a smaller thickness than the width and the height, respectively, of the base member 28 of the second edge 26 of the pad 23. In view of preventing the pad 23 from coming loose accidentally as it is being opened, or as the boot is being used, the transverse member 27 of the second edge 26 of the pad 23 will of course be so shaped and sized as to cause it to be temporarily in an interference fit with the corresponding portions 31 and 32 of the seat 30 during manufacturing (assembly) of the boot or during a possible replacement of the pad 23.

FIGS. 2 to 4 exactly illustrate the progression of the process by which the pad 23 is opened (so as to allow the wearer's foot to slip into and out of the boot) as indicated by the arrow A and, as a result, the free rotation of the edge 26 within the seat 30, as allowed for by the clearance provided in coupling these parts of the boot to each other. In fact, when the pad 23 is opened, the width of the passage opening 19 (which corresponds to the distance of the edge 24 of the pad 23 from the free edge 29 of the flap 22 of the second portion 25 of the leg-piece 20) progressively increases from a minimum value, close to nil (FIG. 2) up to a maximum, very large value (FIG. 4) by passing through an intermediate value (FIG. 3). The same figures also illustrate how the use of the pad 23 made of a more rigid material actually allows for a certain separation—obviously of a solely temporary nature—of the edge 21 of the second portion 25 of the leg-piece 20 that is adjacent to the pad 23.

The advantages of the present invention may be summarized as follows:

- firstly, no need arises for the pad 23 to be caused to flex elastically for the foot introduction into the boot and extraction therefrom, since it can be easily opened and closed, even under conditions of a very low temperature prevailing on the skiing ground;
- secondly, the possibility for the flap 22, the edge 29 of which remains under the pad 23 when the leg-piece 20 is closed and fastened, to be made shorter and more easily deformed elastically, without extending beyond the longitudinal mid plane M—see FIGS. 2 to 4;
- thirdly, the reliability of the whole boot, which is made possible by the use of a synthetic material having superior mechanical properties for the pad 23;
- finally, the cost-effectiveness of the construction (especially if compared with the solution disclosed in the afore-mentioned patent application WO-A-03 001937), since no use is made of small metal parts as typically used in the book-like hinges for joining the pad 23 with the remaining portion 25 of the leg-piece 20; and
- the simple manner in which a replacement of the pad 23 can be carried out.

Among the other manners in which the present invention may be implemented within the scope thereof as defined by the appended claims, the following ones can be cited:

- the use of one or more pad coupled via a clearance fit to the remaining portion of the shell, further to (or instead of) the pad coupled in the same way with the leg-piece of the boot, as here above described;
- the possibility for both the flaps 22, 23 at the passage opening 19 of the leg-piece 20 and/or the similar flaps in the shell 10 to be made in the forms of pads;
- other forms, including at least partially an undercut, for the edges along which the pads are coupled with a clearance fit to slits in the corresponding other portions of the leg-piece and/or lower shell;
- the provision of undercut edges on the parts of the leg-piece and/or lower shell that ensure a clearance-fit coupling to the pads, which will in this case be provided with slits adapted to receive said undercut edges.

The invention claimed is:

1. Sport footwear, comprising:

a lower shell having a portion enclosed in an leg-piece, wherein said lower shell and said leg-piece, which are made of synthetic materials and may enclose an inner lining shoe, are provided frontally with respective passage openings for introduction of a wearer's foot, the respective passage openings roughly extending along a longitudinal mid plane of the footwear and being capable of being closed by respective flaps when partially superimposed upon each other;

first fixation means for joining at least one of said respective flaps to a remaining portion of one or more of the leg-piece and the lower shell; and second fixation means, coupled to said first fixation means with a clearance fit, for allowing said at least one flap to freely rotate with respect to said remaining portion of the one or more of the leg-piece and the lower shell, wherein said first fixation means comprise a transverse member, and said second fixation means comprise a seat for accommodating the transverse member, the seat having a substantially same shape as, but different dimensions from, the transverse member to provide for rotational movement of the first fixation means while coupled to the second fixation means.

2. Sport footwear according to claim 1, wherein said at least one flap is made of more rigid materials than said remaining portion of the one or more of the leg-piece and the lower shell to which it is joined.

3. Sport footwear according to claim 2, wherein said first fixation means comprise an at least partially undercut edge of said at least one flap and the second fixation means comprise the seat provided in the remaining portion of the one or more of the leg-piece and the lower shell.

4. Sport footwear according to claim 3, wherein said at least partially undercut edge has a cross-section in a shape of a T, wherein the transverse member of said T, which is a distal portion of said at least partially undercut edge, is bent at substantially right angle relative to a base member of said T, which is a proximal portion of said at least partially undercut edge.

5. Sport footwear according to claim 4, wherein said seat in the remaining portion of the one or more of the leg-piece and the lower shell has a cross-section in a shape of a T, wherein a transverse portion of said T-shaped seat has a width and a thickness that are larger than the a width and the a thickness of the distal portion of the at least partially undercut edge and wherein a base portion of said T-shaped seat has a width that is greater and a thickness that is smaller than a width and a height, respectively, of the proximal portion of the at least partially undercut edge of the pad.

6. Sport footwear according to claim 1, further comprising:

means for closing said respective passage openings for the wearer's foot, and means for fastening the footwear provided in the one or more of the leg-piece and the lower shell, wherein mutually cooperating parts of said fastening means are secured to said at least one flap and another flap to close said respective passage openings.

* * * * *